US007229054B2

(12) United States Patent
Hu

(10) Patent No.: US 7,229,054 B2
(45) Date of Patent: Jun. 12, 2007

(54) HEIGHT ADJUSTABLE PEDAL RING MECHANISM FOR BAR STOOL

(75) Inventor: Jung-Hua Hu, No. 2, Alley 492, Hai Tien Rd. Sec. 2, 709 Tainan City (TW)

(73) Assignee: Jung-Hua Hu, Tainan Couty (TW)

( * ) Notice: Subject to any disclaimer, the term of this patent is extended or adjusted under 35 U.S.C. 154(b) by 11 days.

(21) Appl. No.: 11/044,767

(22) Filed: Jan. 28, 2005

(65) Prior Publication Data

US 2006/0175518 A1 Aug. 10, 2006

(51) Int. Cl.
*F16M 11/20* (2006.01)

(52) U.S. Cl. ..... 248/188.1

(58) Field of Classification Search ..... None
See application file for complete search history.

(56) References Cited

U.S. PATENT DOCUMENTS 3,458,234 A * 7/1969 Bates ..... 297/423.38
4,948,149 A * 8/1990 Lin et al. ..... 473/492
6,520,192 B1 * 2/2003 Lo ..... 135/25.4
6,695,407 B1 * 2/2004 Lin ..... 297/423.38
6,862,776 B2 * 3/2005 Chen ..... 16/113.1

* cited by examiner

*Primary Examiner*—Robert E. Pezzuto
*Assistant Examiner*—Dat T. Nguyen

(57) ABSTRACT

This invention relates to a height adjustable pedal-ring mechanism for bar stool. This mechanism comprises a main shaft, a taper sleeve, a cross-shaped support frame with a central tube, a pedal ring, and a base frame. The pedal ring is connected to the cross-shaped support frame. The taper sleeve has an outer spiral line on the upper part of the taper sleeve and an outer gradient slope on the lower part of the taper sleeve. The cross-shaped support frame is equipped with a central tube at the central part of the cross-shaped support frame. The central tube has an inner spiral line matching with the outer spiral line of the taper sleeve and an inner gradient slope matching with the outer gradient slope of the taper sleeve. This mechanism employs the outer gradient slope of the taper sleeve and the inner gradient slope of the central tube to fix the vertical position of the pedal ring.

2 Claims, 4 Drawing Sheets

HEIGHT ADJUSTABLE PEDAL RING MECHANISM FOR BAR STOOL

BACKGROUND OF THE INVENTION

As shown in FIG. 1 and FIG. 2, the prior art for bar stool pedal ring raising and lowering mechanism 1 employs one-fix-point design, which comprises a main shaft 11, a pedal ring 12, a cross-shaped support frame 13 with a central tube 14, a C-type sleeve 15, a screw 17, and a screw hole 16 on the middle section of the central tube 14. The pedal ring 12 is connected to the cross-shaped support frame. Through the screw hole 16, the screw 17 serves to fasten the vertical position of the pedal ring 12. When the screw 17 rotates onto the main shaft 11, it presses the C-type sleeve 15 onto the main shaft 11. This prior art design not only need strenuous effort in the fastening process, but also has the following defects:

1. The C-type sleeve 15 is made of plastic material, which has a function to increase the strain force between the screw 17 and the main shaft 11. But when the screw 17 presses the C-type sleeve 15, it damages the surface of the C-type sleeve 15, in the long run the C-type sleeve 15 loses its function.

2. The localized pressure due to one-fix-point design also causes the deformation of the main shaft 11 to decrease the function of the bar stool pedal ring raising and lowering mechanism 1.

3. The vertical position of the pedal ring 12 is fixed only by the screw 17.

As a result, when the user put the foot on the pedal ring 12, the weight of the user tilts the pedal ring 12 and also causes the deformation of the main shaft 11.

As mentioned above, one-fix-point design causes the damage on the C-type sleeve 15 and the deformation of the main shaft 11. The pedal ring 12 and the cross-shaped support frame 13 are easy to be tilted. It endangers the user who is using it.

SUMMARY OF THE INVENTION

This invention relates to a height adjustable pedal ring mechanism for bar stool, which employs the outer gradient slope of the taper sleeve and the inner gradient slope of the central tube to achieve the goal of changing the height of the pedal ring fast. And this invention is also stable and safe for the user.

DETAILED DESCRIPTION OF THE INVENTION

Figure 2:
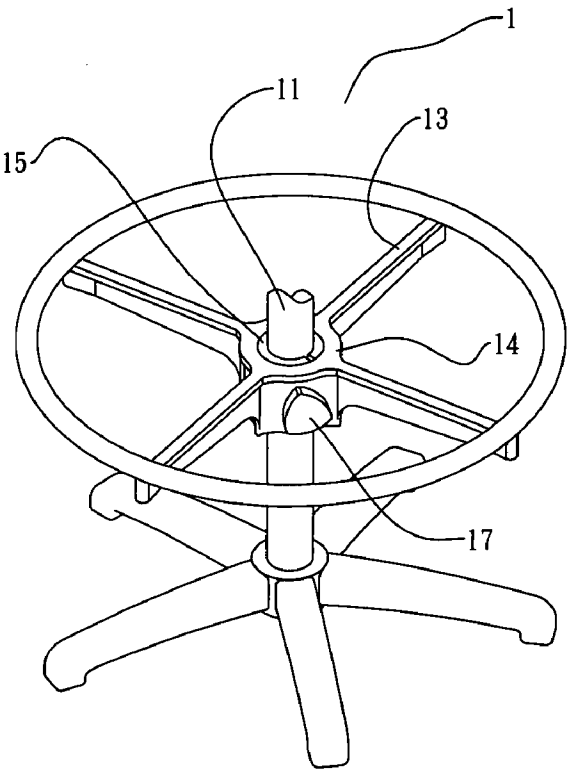
FIG. 2 shows a graphical view of a prior art.
Figure 1:
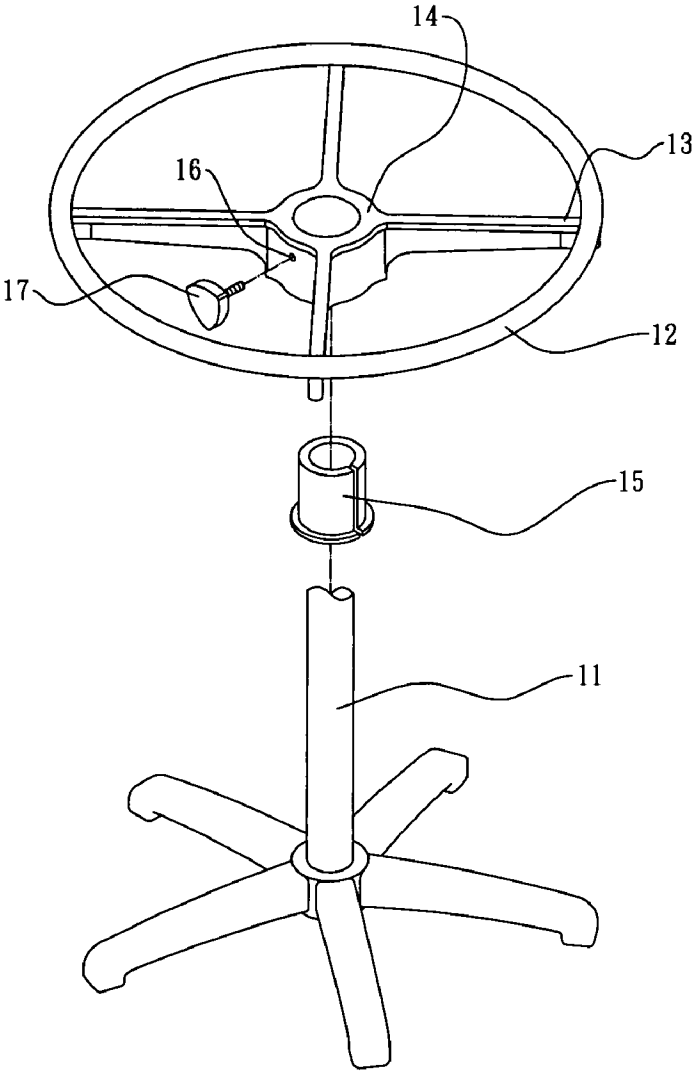
FIG. 1 shows an exploded view of a prior art.
Figure 4:
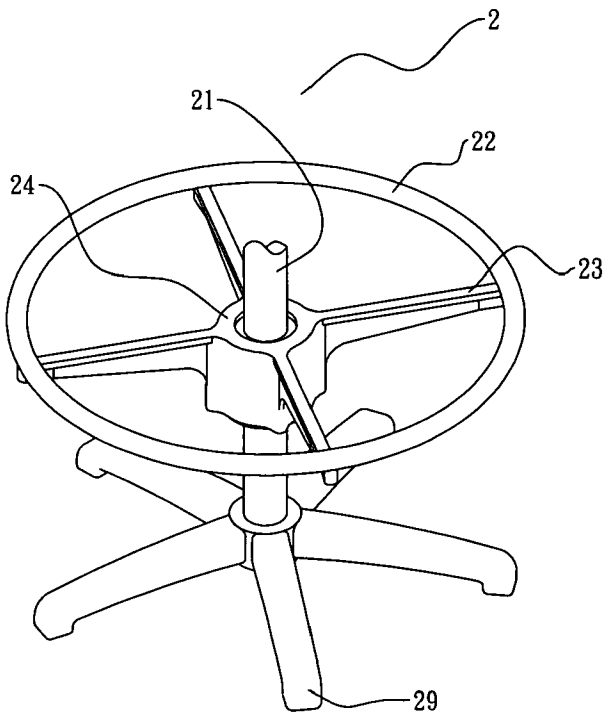
FIG. 4 shows a graphical view of the height adjustable pedal ring mechanism for bar stool.
Figure 3:
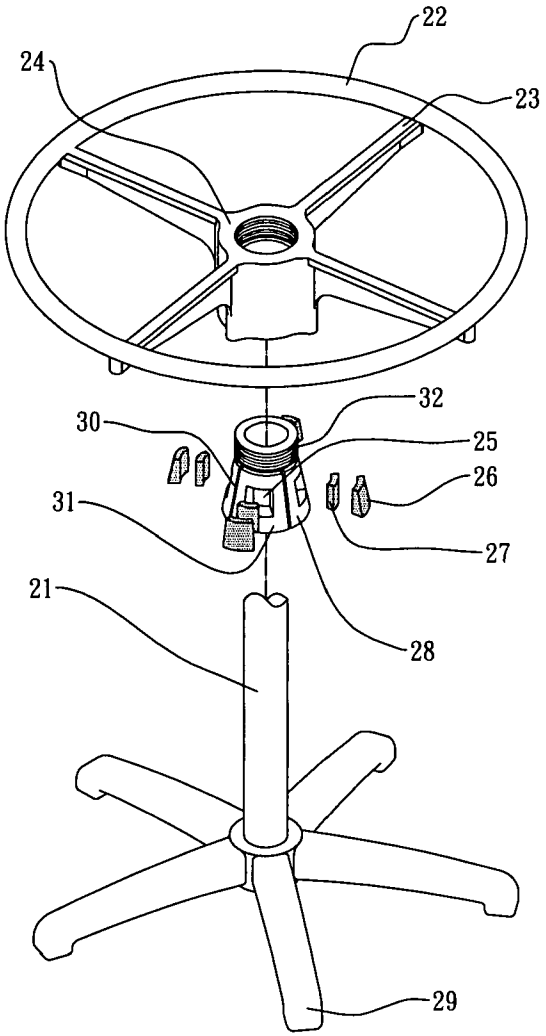
FIG. 3 shows an exploded view of the height adjustable pedal ring mechanism for bar stool.
Figure 6:
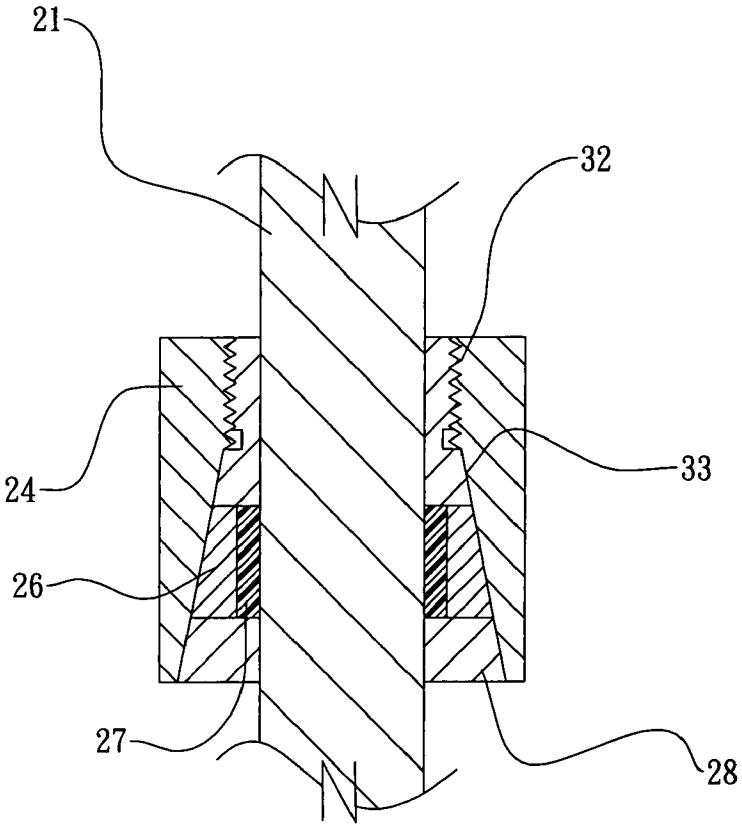
FIG. 6 shows a perspective view of the screw-locking status of the height adjustable pedal ring mechanism for bar stool.
Figure 5:
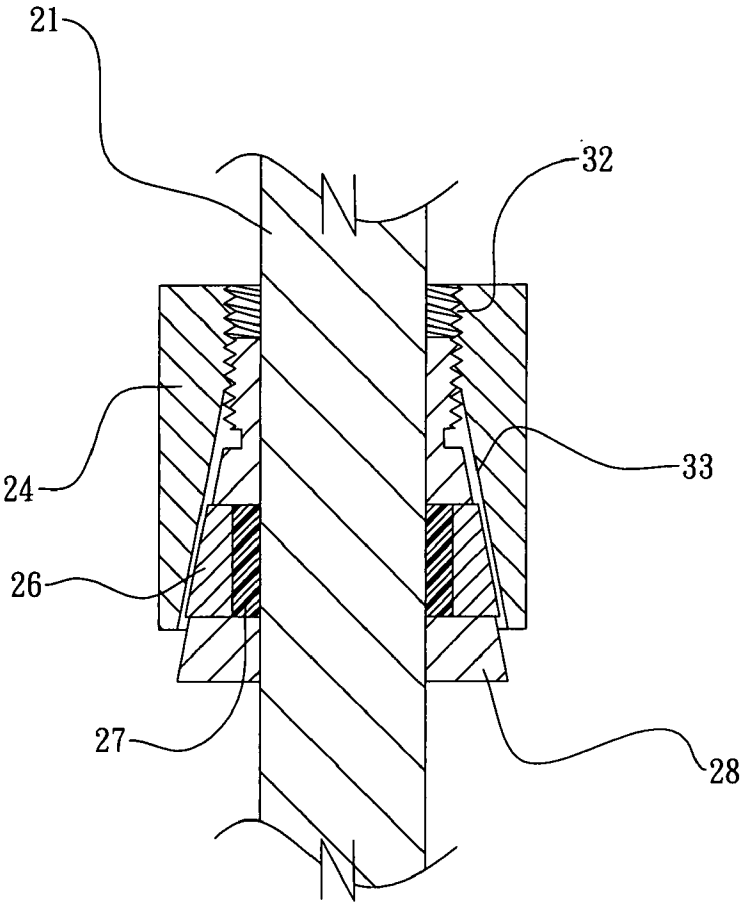
FIG. 5 shows a perspective view of the unlocking status of the height adjustable pedal ring mechanism for bar stool.

As shown in FIGS. 3, 4, 5, and 6, this invention is a height adjustable bar stool pedal ring mechanism 2, comprising a main shaft 21, a cross-shaped support frame 23 with a central tube 24, a pedal ring 22, a taper sleeve 28, and a base frame 29. The pedal ring 22 is connected to the cross-shaped support frame 23, at the central part of the cross-shaped support frame 23 exists a central tube 24. The central tube 24 has an inner spiral line 32 matching with a spiral line of the taper sleeve 28, and an inner gradient slope 33 matching with an outer gradient slope of the taper sleeve 28.

A number of slots 30, which are equipped on the lower part of the taper sleeve 28, separate the lower part of the taper sleeve 28 to a number of circular sect plates 31. Each circular sect plate is equipped with a square hole 25, inside the square hole 25 exists a plastic plate 27, which is covered by a ramp plate 26. When the central tube 24 moves downwards by rotation, the inner gradient slope of the central tube 24 presses the outer gradient slope surfaces of the ramp plates 26, as to push the ramp plates 26 to move inwards and press the plastic plates 27 onto the main shaft 21, thus achieving the goal of fixing the vertical position of the pedal ring. The merits of this invention are described as fallowing:

1. The compression pressure on the lower part of the taper sleeve 28 is applied on the whole surface. This invention prevents the localized pressure induced by one-fix-point design and prolongs the service life of the product.

2. Several plastic plates 27 are evenly pressed onto the main shaft 21, so this invention keep the surface of the main shaft 21 intact.

3. The vertical position of the pedal ring 22 is fixed by the whole surface of all the plastic plates 27, so this invention increases the stability of the pedal ring 22 and prevents the tilt and shaking of the pedal ring 22.

And by the screw-locking design and the gradient-slope design both on the taper sleeve 28 and the central tube 24, the user operates this mechanism in a more efficient and effortless way.

Figure 8:
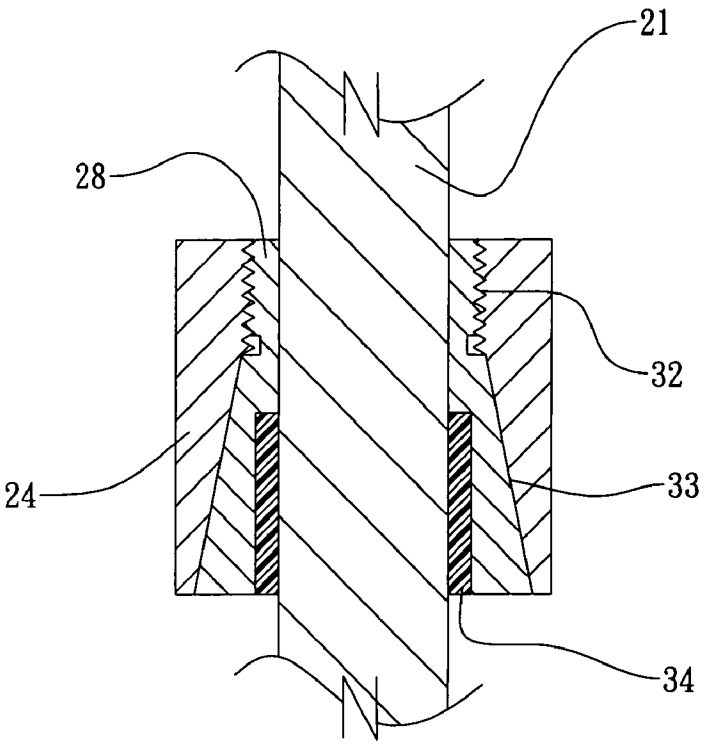
FIG. 8 shows a perspective view of the screw-locking status of another preferred embodiment.
Figure 7:
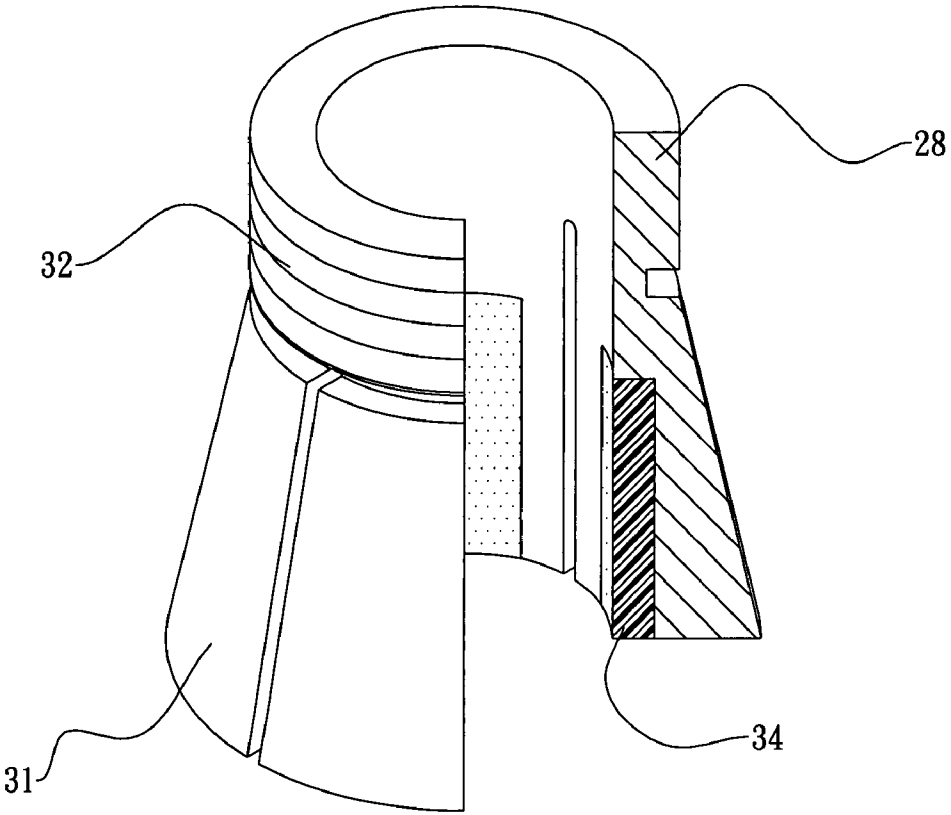
FIG. 7 shows a half-perspective view of the taper sleeve of another preferred embodiment.

Another preferred embodiment is shown in FIGS. 7 and 8, a number of plastic bars 34 are imbedded on the inner sides of the circular sect plates 31 of the taper sleeve 28. When the central tube 24 moves downwards by rotation, the inner gradient slope 33 of the central tube 24 pushes the outer gradient slopes of the circular sect plates 31 of the taper sleeve 28 to move inwards as to press the plastic bars 34 onto the main shaft 21, thus the fixation of pedal ring 22 is achieved.

The invention of claimed is:

1. A mechanism, comprising:

(a) a shaft;

(b) a taper sleeve, which has an outer spiral line on the upper part of the taper sleeve and an out gradient slope on the lower part of the taper sleeve and a number of slots which are equipped on the lower part of the taper sleeve, forming a number of circular section plates, on each circular section plate exists a square hole, a plastic plate is inserted inside the square hole and the plastic plate is covered with a ramp plate, the inner gradient slope of the central tube moves downwards to press outer gradient slopes of the ramp plates in the square holes of the circular section plates of the taper sleeve, and pushes the ramp plate to compress the plastic plates onto the shaft, when the central tube moves downwards by rotation, as to fix the vertical position of the support frame;

(c) a support frame with a central tube, the central tube is equipped at the central part of the support frame, the central tube has an inner spiral line matching with the outer spiral line of the taper sleeve and an inner gradient slope matching with the outer gradient slope of the taper sleeve.

2. A mechanism, comprising:

(a) a shaft (b) a taper sleeve, which has an outer spiral line on the upper part of the taper sleeve and an out gradient slope on the lower part of the taper sleeve and a number of slots equipped on the lower part of the taper sleeve, forming a number of circular section plates, a number of plastic bars are embedded on the inner sides of the circular section plates of the taper sleeve, when the central tube moves downwards by rotation, the inner gradient slope of the central tube moves downwards by rotation, the inner gradient slope of the central tube push the outer gradient slopes of the circular section plates of the taper sleeve to move inwards and compress the plastic bars into the shaft, as to fix the vertical position of the support frame; and (c) a support frame with a central tube, the central tube is equipped at the central part of the support frame, the central tube has an inner spiral line matching with the outer spiral line of the taper sleeve and an inner gradient slope matching with the outer gradient slope of the taper sleeve.

* * * * *